US007464842B2

(12) United States Patent
Gouldson

(10) Patent No.: US 7,464,842 B2
(45) Date of Patent: Dec. 16, 2008

(54) UNIVERSAL LOWER NECK SIZER

(75) Inventor: Stanley F. Gouldson, Northport, NY (US)

(73) Assignee: Spotless Plastics Pty, Ltd., Moorabbin, Victoria (AU)

( * ) Notice: Subject to any disclaimer, the term of this patent is extended or adjusted under 35 U.S.C. 154(b) by 0 days.

(21) Appl. No.: 11/741,398

(22) Filed: Apr. 27, 2007

(65) Prior Publication Data

US 2007/0257071 A1 Nov. 8, 2007

Related U.S. Application Data

(60) Provisional application No. 60/796,774, filed on May 2, 2006.

(51) Int. Cl.
*A41D 27/22* (2006.01)

(52) U.S. Cl. ..... 223/85; 40/322

(58) Field of Classification Search ..... 223/85, 223/88, 92, 95; 40/322; D6/328
See application file for complete search history.

(56) References Cited

U.S. PATENT DOCUMENTS

| | | | | | |
|---|---|---|---|---|---|
| 3,949,914 | A * | 4/1976 | Ostroll | ..... | 223/85 |
| 4,881,836 | A * | 11/1989 | Blanchard | ..... | 40/322 |
| 5,441,182 | A * | 8/1995 | Sullivan | ..... | 223/85 |
| 5,469,995 | A * | 11/1995 | Bredeweg et al. | ..... | 223/85 |
| 5,586,697 | A * | 12/1996 | Johansson | ..... | 223/85 |
| 5,683,018 | A | 11/1997 | Sullivan et al. | | |
| 6,041,983 | A * | 3/2000 | Sullivan et al. | ..... | 223/85 |
| 6,041,984 | A | 3/2000 | Gouldson | | |
| 6,382,478 | B2 * | 5/2002 | Gouldson et al. | ..... | 223/85 |
| 6,726,067 | B2 * | 4/2004 | Louw | ..... | 223/85 |
| 7,287,674 | B1 * | 10/2007 | Sutton et al. | ..... | 223/85 |
| 2006/0213938 | A1 * | 9/2006 | Gouldson | ..... | 223/85 |
| 2007/0187439 | A1 * | 8/2007 | Louw | ..... | 223/85 |

FOREIGN PATENT DOCUMENTS

GB 2283413 A * 5/1995

* cited by examiner

*Primary Examiner*—Gary L. Welch
*Assistant Examiner*—Nathan E Durham
(74) *Attorney, Agent, or Firm*—Scully, Scott, Murphy & Presser, P.C.

(57) ABSTRACT

In a combination hanger and indicator tab, the hanger has a hook extending upward from a body, and forming an angle with the body, with a rib extending around the periphery of the hanger at least in part of the region of the intersection between the hook and the body. The indicator tab has two opposing side walls connected by an end wall. The side walls preferably have a through opening therethrough, while the end walls preferably have a first notch on at least one free side thereof, but more preferably both. A receiving boss extends inward from one or both side walls, the receiving boss having a second notch therein for receiving the rib of the hanger. Optionally, an incline rises from the interior surface of the size wall carrying the receiving boss towards the top of the second notch. A bar suspended by the center thereof between the opposing side walls and the end wall of the indicator has free ends sized and dimensioned to deflect by engaging the rib of the hanger when the rib is received in the second notch of the receiving boss.

2 Claims, 1 Drawing Sheet

UNIVERSAL LOWER NECK SIZER

CROSS REFERENCE TO RELATED APPLICATIONS

The present application is a non-provisional conversion claiming priority to U.S. provisional application No. 60/796,774 filed on May 2, 2006.

BACKGROUND OF THE INVENTION

1. Field of the Invention

The present invention relates generally to the field of garment hangers, and more specifically to a lower neck indicator tab for use with a standardized hanger style.

2. Description of the Related Art

In the area of retail garment sales, so-called Garment-On-Hanger (GOH) programs have become preferred by retailers. In a GOH program, garments are delivered to retail merchants already suspended from hangers, whereupon arrival at the retail location they may immediately be placed on display for sale. Formerly, retailers accomplished this task with labor provided at their own expense.

In particular, retailers have specified particular hangers or hanger characteristics among their several suppliers in order to achieve a visually pleasing uniformity on their sales floors. To this end, standards as to hanger size, shape, performance characteristics, etc., are maintained, for example, by organizations such as the Voluntary Inter-industry Commerce Standards Association (VICS). Among these, one particular standardized hanger feature is extremely popular across several hanger models, incorporating a smooth rounded transition between hanger hook and hanger body, particularly the back side of the hanger hook, where it forms an acute angle with the hanger body.

Additionally, and interrelated to the promulgation of GOH programs, retailers and their customers desire to have the hanger itself display some indicia regarding the item carried upon it. Categories of indicia could include manufacturer, material and price, but most notably for garments, their size. Various means for accomplishing this have been developed, including those disclosed in U.S. Pat. No. 5,884,422 to Marshal, et al., and U.S. Pat. No. 6,019,260 to Gouldson, both of which are commonly assigned with the instant application, among others. Popular among these are the type disclosed in the latter patent just mentioned, i.e., those that secure to the hanger on a back side of the intersection between the hanger hook and the hanger body, appropriately called side-sizer tabs, or simply side-sizers; lower neck sizers or indicators.

However, such side-sizers heretofore known in the art require that the hanger be specifically manufactured to accept the particular indicator. Various other indicators could be made universally adaptable, for example those attached surrounding the hook of the hanger. These generally are free to slide along the length of the hanger hook, and ordinarily come to rest at the base of the hook adjacent the hanger body. However, these do not securely engage with the hanger, nor achieve a desirable appearance.

BRIEF SUMMARY OF THE INVENTION

In order to overcome these and other deficiencies in the prior art, provided according to the present invention is a combination hanger and indicator tab. The hanger has a hook extending upward from a body, and forming an angle with the body, with a rib extending around the periphery of the hanger at least in part of the region of the intersection between the hook and the body.

The indicator tab has two opposing side walls connected by an end wall. The side walls preferably have a through opening therethrough, while the end walls preferably have a first notch on at least one free side thereof, but more preferably both. A receiving boss extends inward from one or both side walls, the receiving boss having a second notch therein for receiving the rib of the hanger. Optionally, an incline rises from the interior surface of the size wall carrying the receiving boss towards the top of the second notch. A bar suspended by the center thereofbetween the opposing side walls and the end wall of the indicator has free ends sized and dimensioned to deflect by engaging the rib of the hanger when the rib is received in the second notch of the receiving boss.

BRIEF DESCRIPTION OF THE DRAWINGS

These and other features, advantages and benefits of the present application will be made apparent with reference to the following detailed description and accompanying figures, wherein like reference numerals refer to like features across the several views, and wherein.

DETAILED DESCRIPTION OF THE INVENTION

Figure 1:
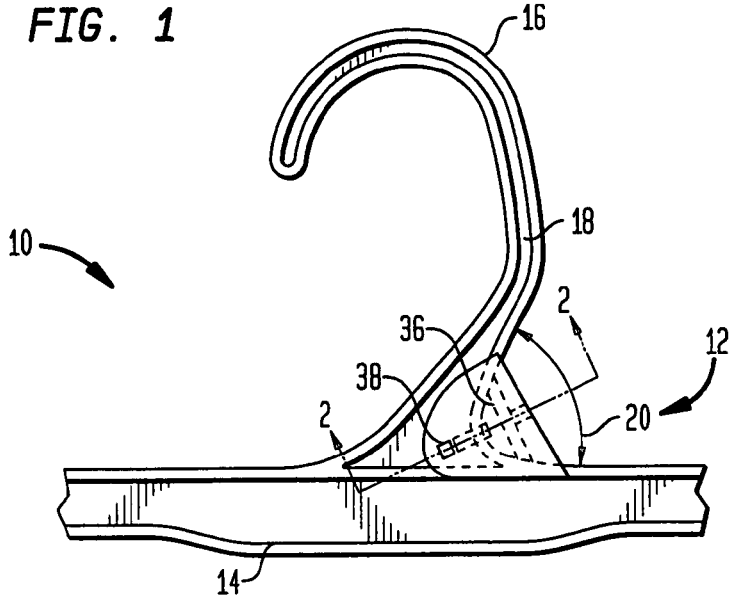
FIG. 1 illustrates a front elevation view of a central portion of a garment hanger and a lower neck sizer according to an exemplary embodiment of the present invention.

Referring now to FIG. 1, illustrated is a central portion of a garment hanger, generally 10, and a lower neck sizer, generally 12, in front elevation view. In FIG. 1, the nearest side wall of the sizer 12 is illustrated as if transparent, to facilitate illustration of the features beneath. Hanger 10 has a body 14, with a hook 16 extending upward from the body 14. The hanger 10 is to be suspended from a support (not shown) by the hook 16. The hook 16 commonly intersects the body 14 at a non-perpendicular angle, therefore being acute to on side and obtuse to the other. This is merely to describe the current state of the art, as the present invention is not limited by the angle of intersection between the hook 16 and the body.

The hanger 10 generally, and the hook 16 in particular, have a rib 18 that borders it. The rib is formed by the cross-sectional shape of the hanger body, whether I-channel, C-channel, or other generally known or hereinafter developed style of cross-section, At the intersection between the hook 16 and the body 14, the rib 18 forms an angle 20, which is an advantageous and desirable position to mount the sizer 12.

Figure 2:
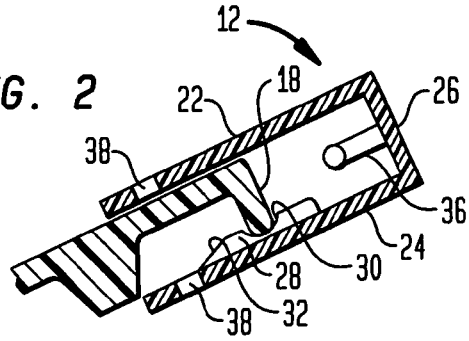
FIG. 2 illustrates the exemplary embodiment in cross-sectional view taken along line 2-2 of FIG. 1.

Referring then to FIG. 2, illustrated is the hanger 10 and sizer 12 in cross-sectional view taken along line 2-2 of FIG. 1. Sizer 12 has opposing side walls 22, 24 which are joined by an end wall 26. Side walls can, but need not, have the same or similar profile, referring to their shape as viewed in FIG. 1. Having the side walls 22, 24 with the same profile creates a symmetric appearance as viewed from either the front or back of the hanger. Moreover, in the exemplary embodiment, the profile shape is generally triangular, with one corner rounded (see FIG. 1). However, the profile shape of the sizer may be varied without departing from the spirit or scope of the invention.

At least one side wall 24 has an inwardly projecting receiving boss 28 which includes a depression or notch 30 for receiving and retaining the rib 18 of the hanger 10. Receiving boss 28 can include a ramp 32 to assist in mounting the sizer 18 to the hanger 10. Moreover, the depth and shape of the notch 30 can be altered to increase or decrease the resistance to removing the sizer 12, and in preferred embodiments, the sizer 12 is so-called child resistant as defined by relevant industry standards, i.e., the force required to remove the sizer 12 is greater than can be applied by a typical child or at least some predetermined portion of the population of children.

In the exemplary embodiment, the rib 18 is open to one side only, and therefore only one receiving boss 28 is necessary or even desirable. However, in other embodiments, e.g., where the hanger 10 has the shape of an I-channel, rib 18 would have a free end to both sides. In that case, a second receiving boss 28 on the opposite side wall 22, 24 could be advantageous, for example to further increase resistance to removal.

Figure 3:
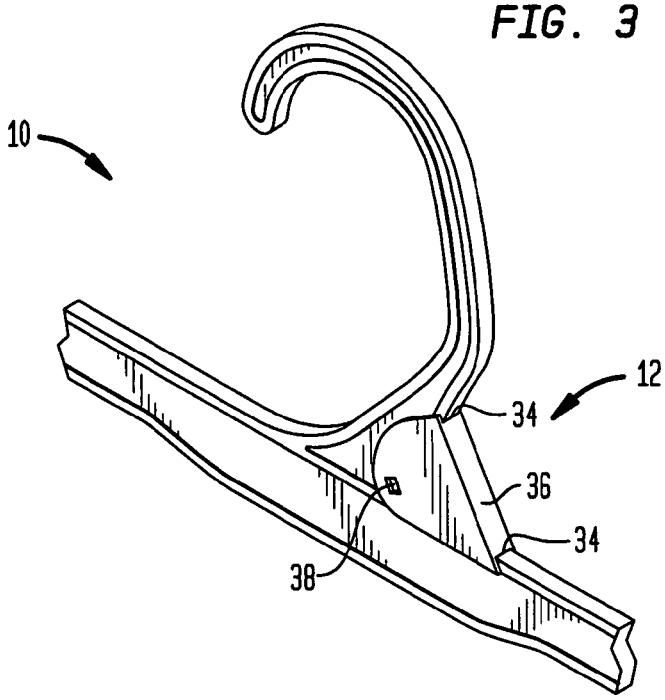
FIG. 3 illustrates a perspective view of the hanger and lower neck sizer of the exemplary embodiment.

Referring to FIG. 3, illustrated is a perspective view of the hanger 10 and sizer 12. Preferably, end wall 26 includes a notch 34 on either or both free sides thereof. When the sizer 12 is mounted to the hanger 10, the rib 18 is received in the notch 34, where the opposing side walls 22, 24 can engage the rib 18 to provide lateral stability.

Optionally, referring again to FIGS. 1 and 2, to further enhance the stability of the sizer 12 when mounted to the hanger 10, the sizer 12 may include a suspended string 36 between the opposing side walls 22, 24, and end wall 26. Suspended string 36 is a bar of material secured to the sizer 12 by the center of the bar, in this case to end wall 26, but optionally or additionally to either or both of side walls 22, 24. Preferably, the ends of the suspended string engage the rib 18 of the hanger 10 and are deflected by it when the sizer 12 is attached to the hanger 10, i.e., when the rib 18 is received in the notch 30. The deflection of the ends of the suspended string applies tension sizer 12, which enhances the engagement of the rib 18 in the notch 30 of receiving boss 28.

As a further enhancement, the sizer 12 may also include a through hole 38, in the case of the exemplary embodiment through both of side walls 22, 24. Through hole 38 allows several sizers 12 to be banded together for packing, shipment, or to facilitate loading into a holding magazine of an machine for automatically attaching the sizer 12 to a hanger 10 as a magazine, or further to permit a magazine feed or vibratory bowl feed machine to orient the sizer 12 before attachment to a hanger 10.

As exemplary only, the material of the sizer 12 and or hanger 10 are generally injection molded plastics, for example polystyrene, SAN, ABS, PPO, nylon, polypropylene (PP), polyethylene, PET, polycarbonates (PC), acrylics, K resin, and polyvinyl chloride (PVC) or variants of any of these. Other plastics, metals, or nearly any material as desired may be used, however, without regard to the particular method of manufacture. Specifically among plastics, the material maybe transparent, translucent, or opaque, or colored as desired nearly without limitation. Additional indicia, for example representative of the manufacturer, material, price, or size of the item suspended from the hanger may be molded or formed integrally with the sizer 12, or applied thereafter. Moreover, the color or mere presence of the sizer 12 may constitute the desired indicia.

The present invention has been described with respect to certain exemplary embodiments. Certain alterations and/or modifications will be apparent to those skilled in the art, in light of the instant disclosure, without departing from the spirit or the scope of the invention. These embodiments are offered as merely illustrative, and not limiting, on the scope of the invention, which is defined solely with reference to the following appended claims.

I claim:

1. A combination of a hanger and an indicator tab therefore:

the hanger comprising:

a hook extending upward from a body, and forming an angle with the body, the hanger having a rib extending round the periphery of the hanger at least in a portion of the region of the intersection between the hook and the body;

the indicator tab comprising:

two opposing side walls connected by an end wall, the end wall having a first notch on at least one free side thereof;

a receiving boss extending inward from at least one side wall, the receiving boss having a second notch therein for receiving the rib of the hanger and an incline rising from the interior surface of the side wall carrying the receiving boss towards the top of the second notch; and a bar suspended by the center thereof between the opposing side walls and the end wall of the indicator, the free ends of the bar sized and dimensioned to deflect by engaging the rib of the hanger when the rib is received in the second notch of the receiving boss.

2. The combination according to claim 1, further comprising at least one of the side walls having a though opening.

* * * * *